United States Patent [19]

Gerhardinger et al.

[11] Patent Number: 4,649,066

[45] Date of Patent: Mar. 10, 1987

[54] ANTICORROSION COATINGS FOR POROUS CONCRETE METAL REINFORCING STRUCTURES

[75] Inventors: Dieter Gerhardinger; Karl-Heinrich Wegehaupt, both of Burghausen; Hans-Rudolf Pfeffer, Emmerting, all of Fed. Rep. of Germany

[73] Assignee: Wacker-Chemie GmbH, Munich, Fed. Rep. of Germany

[21] Appl. No.: 798,048

[22] Filed: Nov. 14, 1985

[30] Foreign Application Priority Data

Jan. 31, 1985 [DE] Fed. Rep. of Germany ..... 3503276

[51] Int. Cl.[4] ..... B05D 3/02

[52] U.S. Cl. ..... 427/387; 427/388.2; 427/393.6; 428/447; 428/450; 525/479

[58] Field of Search ..... 428/447, 450; 528/33, 528/18; 427/136, 387, 393.6, 388.2; 525/479

[56] References Cited

U.S. PATENT DOCUMENTS

| | | | |
|---|---|---|---|
| 4,292,423 | 9/1981 | Kaufmann et al. | 528/18 |
| 4,301,268 | 11/1981 | Kropac | 525/479 |
| 4,435,472 | 3/1984 | Leah | 428/450 |
| 4,503,210 | 3/1985 | Au et al. | 528/33 |
| 4,600,657 | 7/1986 | Wegehaupt et al. | 428/447 |

*Primary Examiner*—Edith Buffalow

[57] ABSTRACT

The present invention relates to a corrosion resistant coating for metal reinforcing structures that are used in porous concrete which comprises coating the metal reinforcing structures with an organopolysiloxane elastomer obtained by crosslinking a diorganopolysiloxane-based composition by the condensation reaction or by the addition of Si-bonded hydrogen to an aliphatic carbon-carbon double bond, in which the composition contains a copolymer that is obtained via a free radical copolymerization of styrene and a (meth)acrylic acid ester in the presence of the diorganopolysiloxane.

6 Claims, No Drawings

ANTICORROSION COATINGS FOR POROUS CONCRETE METAL REINFORCING STRUCTURES

The present invention relates to anticorrosion coatings and more particularly relates to anticorrosion coatings for metal reinforcing structures that are used in porous concrete.

BACKGROUND OF THE INVENTION

Metallic reinforcing materials which are embedded in porous concrete such as metal bars or mesh have a tendency to corrode over a period of time in the presence of a corrosive medium such as aqueous solutions of metallic salts such as, for example, sodium chloride.

It is therefore an object of the present invention to provide a coating for metal reinforcing materials which will prevent corrosion of these materials when embedded in porous concrete. Another object of the present invention is to provide a coating for metal reinforcing materials which are used in porous concrete. Still another object of the present invention is to provide a coating for metal reinforcing structures which are used in porous concrete which is applied only once and that requires little or no energy for drying. A further object of the present invention is to provide a coating for metal reinforcing materials that is thermally stable under relatively high temperatures which are used in some processes for manufacturing porous concrete. A further object of the present invention is to provide a coating that provides a high degree of protection against corrosion even when the coating on the metal reinforcing structures is relatively thin. A still further object of the present invention is to provide an organopolysiloxane elastomeric coating which protects porous concrete metal reinforcing materials against corrosion.

SUMMARY OF THE INVENTION

The foregoing objects and others which will become apparent from the following description are accomplished in accordance with this invention, generally speaking, by providing an organopolysiloxane elastomeric coating for metal reinforcing materials that are used in porous concrete to prevent corrosion of the reinforcing materials, in which the elastomeric coating is a crosslinked diorganopolysiloxane containing a copolymer obtained from the free radical copolymerization of styrene and a methacrylic acid ester in the presence of the diorganopolysiloxane.

DESCRIPTION OF THE INVENTION

The organopolysiloxane elastomers used to coat the metal reinforcing materials used in porous concrete are compositions which can be crosslinked by the condensation reaction or by the addition of Si-bonded hydrogen to an aliphatic carbon-carbon double bond. These elastomers are based on diorganopolysiloxanes containing a copolymer that has been obtained from the copolymerization of styrene and a methacrylic acid ester in the presence of the diorganopolysiloxane by means of free radicals. These compositions may be single component systems, i.e., compositions which are available commercially as a single package; or they may be two-component systems, i.e., compositions which are obtained by mixing at least two components more or less immediately prior to the composition being applied to the reinforcing elements which are to be protected against corrosion.

The diorganopolysiloxane-based compositions containing a copolymer which is obtained from the copolymerization of styrene and a methacrylic acid ester by means of free radicals in the presence of the diorganopolysiloxane, and which can be crosslinked to form elastomers, by the condensation reaction or by the addition of Si-bonded hydrogen to an aliphatic carbon-carbon double bond are well known and have been previously described in the art. The compositions and their methods of preparation are described, for example, in U.S. Pat. Nos. 3,555,109 to Getson; 3,776,875 to Getson; 4,032,499 to Kreuzer et al; 4,014,851 to Bluestein; and in 4,138,387 to Bluestein. These references are incorporated herein by reference.

It is preferred that the compositions based on a diorganopolysiloxane containing a copolymer obtained from the copolymerization of styrene and a methacrylic acid ester by means of free radicals in the presence of the diorganopolysiloxane, which can be crosslinked by the condensation reaction or by the addition of Si-bonded hydrogen to an aliphatic carbon-carbon double bond, comprise from 20 to 80 percent by weight of the diorganopolysiloxane, based on the total weight of the diorganopolysiloxane and the copolymer consisting of styrene and methacrylic acid ester.

Moreover, it is preferred that the copolymers of styrene and methacrylic acid ester which are formed in the presence of the diorganopolysiloxane contain from 35 to 70 percent by weight of units that are derived from styrene and that the remainder consist of units derived from methacrylic acid ester.

The preferred copolymers which are produced in the presence of the diorganopolysiloxane are those consisting of styrene and n-butylacrylate. However, the n-butylacrylate may also be at least partially substituted by, for example, methylacrylate, ethylacrylate, n-propylacrylate, isopropylacrylate, sec-butylacryalte, methylmethacrylate, ethylmethacrylate, npropylmethacrylate, isopropylmethacrylate, n-butylmethacrylate or sec-butylmethacrylate or a mixture of two or more of these (meth)acrylic acid esters.

Because of their availability, it is preferred that at least 80 percent of the number of the SiC-bonded organic radicals of the diorganopolysiloxanes in whose presence the copolymers consisting of styrene and methacrylic acid ester are prepared, be methyl radicals.

The anticorrosion coating compositions of this invention contain the diorganopolysiloxane which can be crosslinked by the condensation reaction or by the addition of Si-bonded hydrogen to an aliphatic carbon-carbon double bond, the copolymer of styrene and methacrylic acid ester which is prepared in the presence of the diorganopolysiloxane, crosslinking agents such as methyltris-(methylethylketoximo)-silane and a crosslinking catalyst such as di-n-butyltin dilaurate. In addition, the compositions may also contain additional materials, such as diorganopolysiloxanes, especially a dimethylpolysiloxane having an Si-bonded hydroxyl group in each of its terminal units and which has a viscosity of 50 to 100,000 mPa.s at 25° C. These diorganopolysiloxanes are preferably present in the compositions in an amount of from 10 to 80 percent by weight, based on the total weight of the composition. Other additives which may be present in the coating compositions are inorganic fillers, such as pyrogenically produced silicon dioxide and organic solvents.

The compositions of this invention may be applied to the metal reinforcing materials by any method that is suitable for applying liquid or paste-like substances. These compositions may be applied by immersion, spraying, coating, pouring or rolling. After the compositions have been applied to the metal reinforcing materials, they are crosslinked to form organopolysiloxane elastomers. Crosslinking may take place at room temperature, or it may be accelerated by heating to between 50° and 150° C., and more preferably about 70° C., for example, by induction heating. It is preferable that the coatings be applied at a thickness of from about 30 to 200 microns, and more preferably from about 60 to 80 microns.

It is preferred that the metal reinforcing materials which are coated with the diorganopolysiloxane-based compositions be made of iron or iron alloys, especially reinforcing steel.

These coated metal reinforcing materials are employed in porous concrete such as gas concrete, foam concrete or lightweight concrete.

The following example describes a preferred embodiment of this invention.

EXAMPLE (a) To a 4-liter flask equipped with an agitator, a reflux condenser, a thermometer and a dropping funnel, and containing 380 g (4.36 mol) of methylethylketoxime, 140 g (2.33mol) of ethylenediamine and 1.5 liter of toluene is added over a period of 2½ hours, a mixture consisting of 56.7 g (0.33 mol) of silicon tetrachloride and 150 g (1 mol) of methyltrichlorosilane in 375 g of toluene. The contents of the flask increases to about 60° C. After the addition of the silane mixture, stirring is continued for an additional 2 hours and then the mixture is filtered to remove the amine-hydrochloride. Toluene and other volatile materials are then removed from the filtrate in a rotating evaporator at about 16 hPa (abs.). The product consists of 385 g of a clear mixture that is liquid at room temperature and which consists of methyltris-(methylethylketoximo)-silane and tetra(methylethylketoximo)-silane.

(b) A polymerization reactor having an inside diameter of 312 mm which is equipped with a 50 rpm anchor stirrer having a maximum diameter of 295 mm and in addition a gas inlet port, a reflux condenser and temperature recorder is used to heat over a period of 7 hours under an atmosphere of nitrogen, and with the aid of an aqueous steam jacket that is maintained at a temperature of 100° C., a mixture comprising 5.2 kg (50 mol) of styrene, 4.2 kg (33 mol) of n-butylacrylate, 4.04 kg of dimethylpolysiloxane having an Si-bonded hydroxyl group in each of its terminal units and having a viscosity of 430 mPa.s at 25° C., 0.8 kg of water and 0.141 kg of 1,1-di-tert-butylperoxy-3,3,5-trimethylcyclohexane. The contents of the polymerization reactor is maintained at a temperature at or below 97° C.

In order to remove unreacted moncmers and water, nitrogen is then blown through the reaction mixture at a temperature between 100° and 130° C. and subsequently the reaction mixture is heated to a temperature of 130° C. for 3 hours at 16 nPa (abs.). The viscosity of the resultant mixture is 22,000 mPa.s at 25° C.

(c) About 125 parts by weight of the mixture prepared in (b) above are mixed in the following sequence with 11 parts by weight of a dimethylpolysiloxane having an Si-bonded hydroxyl group in each of its terminal units and having a viscosity of 500 mPa.s at 25° C., 4 parts by weight of a dimethylpolysiloxane having an Si-bonded hydroxyl group in each of its terminal units and having a viscosity of 20,000 mPa.s at 25° C., 13 parts by weight of a mixture containing one part by weight of silane mixture whose preparation was described in (a) above, one part by weight of methyltris-(methylethylketoximo)-silane and 4 parts by weight of silicon dioxide that was produced in the gaseous phase and which has a BET-surface area of 200 $m^2g$. Air bubbles are evacuated from the resultant composition, and then 41 parts by weight of an alkane mixture having a boiling range of from 100° to 140° C. at 1,020 hPa (abs.) are mixed in the composition. The dispersion thus obtained has a viscosity of about 25,000 mPa.s at 25° C. (d) Metal reinforcing rods are coated with the composition prepared in (c) above, and then exposed to atmospheric air for 7 days. The coated rods are then incorporated in gas concrete blocks which are then immersed for a period of 2 hours at a time, over a period of 3 days for a total of 10 times in a 3 percent by weight aqueous solution of sodium chloride and then air-dried. Similar gas concrete blocks containing untreated reinforcing rods are exposed to salt water and thereafter the reinforcement rods are removed from the concrete and the extent of rust on the reinforcing rods determined.

The results are shown in the following table.

TABLE

| Coating | Coating thickness in microns | Rust as a percentage of rust covering untreated rods |
|---|---|---|
| Prepared according to Method (d) | 70 | Less than 1 |
| Prepared according to method (d) | 100 | Less than 1 |
| Bitumen* | 300 | 2 to 7 |
| Bitumenlatex* | 300 | 2 to 7 |
| Cementbitumen* | 500 | 1 to 5 |
| Cementlatex* | 500 | 1 to 5 |

*Commercially available products.

What is claimed is:

1. An anticorrosive coating for metal reinforcing structures which comprises metal reinforcing structures having an organopolysiloxane elastomeric coating thereon, said organopolysiloxane elastomeric coating is a crosslinked diorganopolysiloxane copolymeric composition which is obtained from the free radical copolymerization of styrene and a(meth)acrylic acid ester in the presence of the diorganopolysiloxane.

2. The coating of claim 1, wherein the diorganopolysiloxane copolymeric composition is crosslinked by a condensation reaction.

3. The coating of claim 1, wherein the diorganopolysiloxane copolymeric composition is crosslinked by the addition of Si-bonded hydrogen to an aliphatic carbon-carbon double bond.

4. A process for rendering porous concrete metal reinforcing structures resistant to eorrosion which comprises applying a crosslinkable diorganopolysiloxane copolymeric composition which is obtained from the free radical copolymerization of styrene and (meth)acrylic acid ester in the presence of the diorganopolysiloxane to the reinforcing structures and thereafter crosslinking the diorganopolysiloxane copolymeric composition.

5. The process of claim 4, wherein the diorganopolysiloxane copolymeric composition is crosslinked by a condensation reaction.

6. The process of claim 4, wherein the diorganopolysiloxane copolymeric ccmposition is crosslinked by the addition of Si-bonded hydrogen to an aliphatic carbon-carbon double bond.

* * * * *